US009816244B2

(12) United States Patent
Peng et al.

(10) Patent No.: US 9,816,244 B2
(45) Date of Patent: Nov. 14, 2017

(54) PILE-FORMING METHOD FOR COMPOUND EXTRUDED AND EXPANDED PILE AND PILE-FORMING EQUIPMENT FOR COMPOUND EXTRUDED AND EXPANDED PILE

(71) Applicant: Guijiao Peng, Haikou (CN)

(72) Inventors: Guijiao Peng, Haikou (CN); Xinhua Wang, Wuhan (CN); Ying Peng, Haikou (CN); Yanji Tang, Hailkou (CN); Pengfei Long, Wuhan (CN)

(73) Assignee: Guijiao Peng, Haikou (CN)

( * ) Notice: Subject to any disclaimer, the term of this patent is extended or adjusted under 35 U.S.C. 154(b) by 0 days.

(21) Appl. No.: 15/032,564

(22) PCT Filed: Jul. 2, 2014

(86) PCT No.: PCT/CN2014/081476
§ 371 (c)(1),
(2) Date: Apr. 27, 2016

(87) PCT Pub. No.: WO2015/058555
PCT Pub. Date: Apr. 30, 2015

(65) Prior Publication Data

US 2016/0244932 A1 Aug. 25, 2016

(30) Foreign Application Priority Data

Oct. 27, 2013 (CN) ..... 2013 1 0515642

(51) Int. Cl.
*E02D 5/44* (2006.01)
*E02D 5/34* (2006.01)
(Continued)

(52) U.S. Cl.
CPC ..... *E02D 5/34* (2013.01); *E02D 15/04* (2013.01); *E21B 10/44* (2013.01); *E02D 5/44* (2013.01);
(Continued)

(58) Field of Classification Search
CPC .... E02D 5/44; E02D 5/34; E02D 5/45; E02D 15/04
(Continued)

(56) References Cited

U.S. PATENT DOCUMENTS 3,422,629 A * 1/1969 Watts ..... E02D 5/36 175/292
4,027,490 A * 6/1977 Stade ..... E02D 5/32 175/258
(Continued)

FOREIGN PATENT DOCUMENTS

CN 1904225 1/2007
CN 101012649 8/2007
(Continued)

OTHER PUBLICATIONS

International Search Report dated Oct. 15, 2014 from application serial No. PCT/CN2014/081476.

*Primary Examiner* — Frederick L Lagman
(74) *Attorney, Agent, or Firm* — Hogan Lovells US LLP

(57) ABSTRACT

A pile-forming method for a compound extruded and expanded pile, comprising using a compound extrusion and expansion drilling tool of pile-forming equipment for a compound extruded and expanded pile to drill, extrude, and expand to form a bore, wherein when upwardly rotating and lifting, expansion bodies of the compound extrusion and expansion drilling tool enlarge, and at the same time, a concrete pump is started up to pour a pile material under pressure into the pore for the pile, to reach a pile top mark
(Continued)

height, obtaining a compound extruded and expanded pile. Pile-forming equipment for a compound extruded and expanded pile is also disclosed, comprising a compound extrusion and expansion drilling tool and a control system thereof. The compound extrusion and expansion drilling tool comprises a drill stem. A plurality of expansion bodies are provided on a threaded section of a drill bit of the drill stem.

10 Claims, 9 Drawing Sheets

(51) Int. Cl.
*E02D 5/56* (2006.01)
*E21B 10/44* (2006.01)
*E02D 15/04* (2006.01)

(52) U.S. Cl.
CPC ..... *E02D 5/56* (2013.01); *E02D 2250/003* (2013.01); *E02D 2250/0038* (2013.01)

(58) Field of Classification Search
USPC ..... 405/237, 238, 240
See application file for complete search history.

(56) References Cited

U.S. PATENT DOCUMENTS

| | | | | | |
|---|---|---|---|---|---|
| 4,046,205 | A * | 9/1977 | Asayama | E02D 5/44 | 175/292 |
| 4,411,557 | A * | 10/1983 | Booth | E02D 5/54 | 405/238 |
| 4,547,106 | A * | 10/1985 | Lipsker | E02D 5/803 | 405/237 |
| 5,219,246 | A * | 6/1993 | Coutts | E02D 5/36 | 175/292 |
| 5,460,231 | A * | 10/1995 | Collins | E21B 10/322 | 175/258 |
| 6,685,398 | B1 * | 2/2004 | Gunther | E02D 3/126 | 405/233 |
| 2009/0285637 | A1 * | 11/2009 | Wright | E02D 5/36 | 405/232 |

FOREIGN PATENT DOCUMENTS

| | | |
|---|---|---|
| CN | 103556625 | 2/2014 |
| EP | 1471186 | * 10/2004 |
| GB | 2455303 | 6/2009 |
| JP | S6351209 | * 10/1988 |
| JP | 3579869 | 1/2002 |

* cited by examiner

PILE-FORMING METHOD FOR COMPOUND EXTRUDED AND EXPANDED PILE AND PILE-FORMING EQUIPMENT FOR COMPOUND EXTRUDED AND EXPANDED PILE

TECHNICAL FIELD

The present invention pertains to the field of civil engineering, and relates to a pile-forming method for a compound extruded and expanded pile and pile-forming equipment for a compound extruded and expanded pile.

BACKGROUND ART

In the field of civil engineering, foundation piles can be classified into three major categories, a non-displacement pile, a partial-displacement pile, and displacement pile, according to influences on soil by the pile-forming method. A pile body of a foundation pile can be shaped with a uniform section or a variable section. The shape of the pile body and the pile-forming method directly determine the bearing capacity, construction speed, project costs, environment protection of the pile and other issues. During the process of continuous evolution of the pile types and the pile-forming methods of the foundation piles, generation of piles with a variable section greatly increases a side frictional force of the piles, so that the pile length is shortened, the pile diameter is decreased, the number of the piles is reduced, significantly reducing the construction costs. Because caisson piles, which are of the non-displacement type, have many problems in terms of technology, cost, and environment protection, such as low bearing capacity of a single pile and pollution of slurry, it is always pursued in the geotechnical engineering field to develop new pile types and construction methods which are not only environmentally friendly and of high bearing capacity, but also economic, especially piles of reasonable displacement type capable of forming a bore and forming a pile in one step, the reason is that in addition to prominent technical and cost advantages, the construction method of such displacement pile, compared with the non-displacement pile, have advantages in terms of construction benefit and environment protection, such as high construction speed, no slurry pollution, no vibration, and low noises.

Currently, as for displacement piles having branches and forks and being capable of forming a bore and forming a pile in one step, extruding and expanding devices, drill stems, piling machine, and pile-forming methods, such as a three-fork extruded and expanded pile, a branch pile, a thread pile, a spiral extruded and expanded pile, a half-screw pile, rotary extruded caisson pile and the like, are domestically reported in relevant documents. These pile types have their special advancement and inventiveness to some extent, but at the same time also have the following defects and problems.

1. The three-fork extruded and expanded pile and the branch pile:

The three-fork extruded and expanded pile and branch pile (e.g. CN201109909Y and CN102021905A), which are caisson piles with a variable section, have a pile body and forks or plates, and their side resistance and end resistance are greatly improved compared with the soil-withdrawal type of caisson piles with a uniform section, but their pile-forming method is relatively complex, the pile-forming procedure is tedious, including drilling a bore→extruding and expanding→cleaning the bore→measuring the diameter of the bore→placing a reinforcement cage→pouring a concrete, increasing the time and costs for constructing a single pile, wherein in case of the soil layer with a higher underground water level, the phenomenon of bore collapse easily occurs during the construction, moreover, the removed soil to be transported out easily causes environmental pollution. All of subsequent corresponding patents are related to modifications to the extruding and expanding devices to improve efficiency of the extruding and expanding methods, but a bore is still pre-formed before forming a pile in their pile-forming methods.

For example, an integrated long-spiral drilling tool for an extruded and expanded branch pile disclosed in CN201334661Y and similar integrated long-spiral drilling tools for an extruded and expanded branch pile make new improvements on the pile-forming methods of the branch piles. After the drilling tool drills to a designed depth, a supporting branch is formed through extrusion and expansion, the pile construction is completed after the drilling tool is lifted from the ground. Although the pile-forming method becomes easy and quick, it is still needed to remove soil in its construction process, resulting in environmental pollution caused by soil transported out. Moreover, there is loose soil at the pile end, thus the settlement deformation is large. Particularly, during the extruding and expanding process of the drilling tool, an extruding and expanding arm is located at the most unfavorable operation angle when it distracts, the maximum bending moment it bears easily breaks or damages its root portion, moreover, in case of relatively hard soil, it is hard for the extruding and expanding arm to distract merely through a hydraulic cylinder. When multiple hydraulic cylinders are hinged, high control preciseness is required, but it is easy to cause mechanical failure, and the equipment costs and the maintenance costs are high.

2. The thread pile with a variable section:

The thread pile with a variable section (e.g. CN2716480Y and CN102162248A) is a pile of soil-displacement type and a fully-threaded pile, and its construction needs to pre-form a bore with a bore-forming machine.

3. The bidirectional spiral extruded and expanded pile:

The bidirectional spiral extruded and expanded pile (e.g. CN101012649A and CN20218431 U) is a cylindrical pile with a uniform section and belongs to a full soil displacement pile. The advantage of this pile is that soil is compacted by a drilling tool so that a side resistance of the pile is prominently improved, while the disadvantage is that in case of relatively hard soil, it is hard for the drilling tool with a bidirectional spiral extruding and expanding drilling bit to drill forward, making it difficult to form a pile, moreover, the pile formed through its extrusion and expansion has the same outer diameter with that of the drilling tool, therefore the energy consumption is significant.

4. The half-screw pile (also called as a screw pile)

The half-screw pile (also called as a screw pile, e.g. CN1254587C, CN1904225A, and CN101016743U) is a pile of soil-displacement type with a variable section. A pile machine reasonably compacts soil according to sensitivity of the soil, therefore negative effects of extruding soil will not be created. The pile-forming method uses a simple mechanical principle so that a rotational force bearing direction is identical with a rotating direction, which can realize expansion and retraction, the bearing capacity of the formed pile is relatively high. Many inventions of this pile and its technologies have been widely applied in the processing of pile foundation and foundation base in the construction field, therefore this technology can substantially improve the bearing capacity and the construction cost of a single pile, thus good social and economic benefits have been obtained, but it still has its limitations. As a result, it is limited in the application range, moreover, a torque of a drill stem needed after the diameter is increased is also correspondingly increased, greatly increasing the mechanical cost, and the energy consumption is large, which should be overcome.

5. The rotary extruded caisson pile

The rotary extruded caisson pile (e.g. CN101016743A) is a caisson pile of soil-displacement type, with its pile body having a uniform diameter or the pile end having an enlarged head. Its construction is realized by a synchronization technology and a non-synchronization technology in a pile machine control system. It may be applied in a wide range, but still has certain limitations. The enlarged head of its pile end is formed using the principle of an expansion bolt, the drill stem used in construction performs the output through double motors, whose cost is relatively high, moreover, the mechanical movement is relatively complex during outward expansion, which easily causes wearing consumption and should be overcome.

DISCLOSURE OF THE INVENTION

An object of the present invention is to provide a pile-forming method for a compound extruded and expanded pile and a pile-forming equipment for a compound extruded and expanded pile, which have a higher bearing capacity, less settlement, better pile-forming quality, lower costs, lower energy consumption and higher efficiency, and are capable of performing construction operations under complex geological conditions, in order to overcome the above mentioned problems and defects existing in the prior art.

The technical solutions used in the present invention are as follows:

a pile-forming method for a compound extruded and expanded pile, comprising steps as follows:

1. starting up, after a drilling machine for piling work installed with a pile-forming equipment for a compound extruded and expanded pile is located in place, the drilling machine for piling work, to apply a torque in a clockwise direction and a downward axial pressure, and using a drilling tool of the pile-forming equipment for a compound extruded and expanded pile to drill, extrude, and expand to form a bore, wherein after extrusion and expansion, a diameter of the bore for a pile is equal to an outer diameter of the drill stem, the drilling tool of the pile-forming equipment for a compound extruded and expanded pile is rotated downwardly to mechanically extrude and expand to form the bore until a designed depth is reached;

2. starting up, after the mechanical extrusion and expansion of the bore for the pile is completed in the first step, the drilling machine for piling work, to rotate anticlockwise and lift the drilling tool, the expansion bodies of the pile-forming equipment for a compound extruded and expanded pile enlarging, wherein the expansion bodies are always in an enlarged state during a process of lifting the drilling tool of the pile-forming equipment for a compound extruded and expanded pile; starting up a concrete pump while the drilling tool of the pile-forming equipment for a compound extruded and expanded pile starts to be upwardly rotated and lifted, wherein under effect of pressure of the concrete pump, the inner sleeve is separated from the outer sleeve, and the inner sleeve slides in the sliding groove until arriving at a stop pin hole, at this time, it is in a separate state; the concrete passes through a hollow concrete conveying pipe to rush out from a valve, and quickly fill up the drill tip and pile up with at least a prescribed height, wherein during a process of lifting the drilling tool of the pile-forming equipment for a compound extruded and expanded pile, the concrete is pumped continuously, and is always kept higher than a prescribed valve height;

3. keeping the lifting speed equal to a product of a rotating speed and a thread lead, until the pile material is poured under pressure up to a pile top mark height, obtaining a compound extruded and expanded fully-threaded pile;

4. manually resetting, after the drilling tool of the pile-forming equipment for a compound extruded and expanded pile is lifted to the ground, the enlarged portion of the drill stem to an initial state, completing the pile construction.

Further, in a first improved technical solution of the present invention, the lifting speed is equal to a product of the rotating speed and a thickness of an end portion of a thread tooth, and the remaining steps are similar, obtaining a compound extruded and expanded shallow-threaded pile.

Further, in a second improved technical solution of the present invention, after formation of the bore for the pile is completed through mechanical extrusion and expansion, the drilling machine for piling work is started up to rotate anticlockwise in situ, so that the formed bore is further expanded and extruded by the expansion bodies of the equipment, forming a cylinder having a diameter equal to that of the enlarged portion of the equipment, and then the drilling tool is lifted, at the same time, the concrete is pumped, keeping the lifting speed not greater than the product of the rotating speed and a thickness of a rotating arm until the pile material is poured under pressure to reach a pile top mark height, forming a compound extruded and expanded non-threaded pile.

Further, in a third improved technical solution of the present invention, after formation of the bore for the pile is completed through mechanical extrusion and expansion, the drilling machine for piling work is started up to rotate anticlockwise in situ, so that expansion bodies of the pile-forming equipment for a compound extruded and expanded pile are enlarged, making the formed bore further expanded and extruded by the expansion bodies of the equipment, forming a cylinder having a diameter equal to that of the enlarged portion of the equipment, and then the drilling tool is rotated to be lifted, and a concrete is pumped continuously, wherein when the cylinder formed through extrusion is filled up with the concrete, the drilling machine for piling work rotates clockwise in situ, so that the expansion bodies are changed into a retraction state, keeping the rotating speed and the lifting speed until the pile material is poured under pressure to reach a pile top mark height, forming a compound extruded and expanded pile with an enlarged head. According to the design of the pile-forming solution, by repeating the above mentioned steps of forming the enlarged head at any positions of the bore for the pile, a compound extruded and expanded pile can be formed, with a plurality of enlarged heads on the pile body.

Further, in a fourth improved technical solution of the present invention, after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thread lead, wherein a concrete is pumped continuously while the drilling tool of the pile-forming equipment for a compound extruded and expanded pile starts to be upwardly rotated and lifted; when the drilling tool rises to a straight-rod section, a torque in an anticlockwise direction is applied, and the expansion bodies are changed into an enlarged state;

after a space where the expansion bodies are located is extruded into a cylinder shape and the concrete has been filled in, a torque in a clockwise direction is applied; the speed of lifting the drilling tool is kept not greater than a product of the rotating speed and a thickness of the rotating arm until the pile material is poured under pressure to reach a pile top mark height, forming a compound extruded and expanded shallow-threaded pile.

Further, in a fifth improved technical solution of the present invention, after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thickness of an end portion of a thread tooth, wherein a concrete is pumped continuously while the drilling tool of the pile-forming equipment for a compound extruded and expanded pile starts to be rotated upwardly and lifted; when the drilling tool rises to a straight-rod section, a torque in an anticlockwise direction is applied, and the expansion bodies are changed into an enlarged state; after a space where the expansion bodies are located is extruded into a cylinder shape and the concrete has been filled in, a torque in a clockwise direction is applied; the speed of lifting the drilling tool is kept not greater than a product of the rotating speed and a thickness of the rotating arm until the pile material is poured under pressure, to reach a pile top mark height, forming a compound extruded and expanded shallowly-threaded pile.

Further, in a sixth improved technical solution of the present invention, the drill stem perpendicular to the ground is changed to form 0-90° with the ground, and the remaining of the pile-forming solution is similar to the above mentioned technical solutions and the improved technical solutions, and the drill stem can be used as an anchoring rod.

All of the piled formed in the above are collectively known as a compound extruded and expanded pile.

A pile-forming equipment for a compound extruded and expanded pile of the above mentioned pile-forming method for a compound extruded and expanded pile comprises a compound extrusion and expansion drilling tool and a control system thereof, wherein the compound extrusion and expansion drilling tool comprises a drill stem, and a plurality of expansion bodies are provided on a threaded section of a drill bit of the drill stem.

The drill stem comprises a hollow outer sleeve and an inner sleeve provided inside the outer sleeve, an upper portion of the outer sleeve is connected with a conventional drill stem, a bottom portion of the outer sleeve is provided with more than one boss circumferentially distributed, a sliding groove which can be used for linear sliding of the inner sleeve is provided at an inner side of the outer sleeve, a lower portion of the inner sleeve is provided with more than one valve used for pouring a pile material under pressure, the inner sleeve is provided with a transition panel at a position below the valves, a lower surface of the inner sleeve is connected with a connector, wherein an upper surface of the connector has a recess matching bottom portions of the bosses of the outer sleeve, a lower surface of the connector is a hexagonal-prism boss, the connector is connected with a rectangular-pyramid drill tip through the hexagonal-prism boss. According to the design of the present invention, the drill tip also can be directly designed to have more than one unidirectional valve provided on the bottom portion of the drill tip, and the concrete directly flows out from the unidirectional valve.

The expansion body is provided on the threads along an Archimedean spiral line, and comprises expansion female teeth, rotating arms, and sliding arms, the expansion female tooth forms one section of the intact thread tooth, and has stop means at both ends thereof, the expansion female tooth is provided with an expansion sliding groove, one end of the expansion sliding groove has one hinge point, the rotating arm has one end connected to the expansion sliding groove and one end hinged with the sliding arm, the sliding arm has one end hinged with the rotating arm and one end assembled into the sliding groove to slide therein. When the drill stem is rotated clockwise, the expansion body initially is in a retraction state; when the drill stem is rotated anticlockwise, under combined effect of a torque of the pile machine, the frictional force of the soil, the pressure and so on, the rotating arm in the expansion female tooth is allowed to slide towards the hinge point and to be rotated clockwise along with the rotating arm until it arrives at an extreme position, entering an enlarged state. The expansion body in the enlarged state recovers the retraction state very easily under an acting force in the anticlockwise direction.

Further, in the first to sixth improved technical solutions of the present invention, the expansion female teeth of the expansion body and thread teeth of threads of the drill bit are arranged with equal thread pitches, a cross-section of the expansion female tooth is a variable cross-section polygon, with a thickness of a tooth root thereof being greater than a thickness of a tooth crest, one end of the sliding arm of the expansion body, in a cylindrical shape, slides in the expansion sliding groove, the rotating arm and the sliding arm have semi-lunar portions with a thickness smaller than the thickness of the tooth crest of the expansion female tooth, and smaller than a thickness of a cylinder at an end thereof.

Further, in the sixth improved technical solution of the present invention, through improvement on the equipment, a main stand forms an angle of 0-90° with ground under an effect of winching or a hydraulic cylinder, to complete construction of an anchoring rod A control system used in the present invention is an automatic control system which performs the match and control of double motors of the pile machine, i.e., a motor of lifting and pressurizing the drill stem and a motor of rotating the drill stem. Positive rotation and reverse rotation of the drill stem can be controlled through the automatic control system according to requirements, and it can realize: 1) positive rotation and reverse rotation of the drill stem; 2) passive-type retraction and enlargement of the expansion body; 2) keeping different mathematical relationships between a speed v of lifting the drill stem and a rotating speed n of the drill stem, to realize four basic types of the shape of the pile body as follows:

1) forming, when the lifting speed is equal to a product of the rotating speed and the thread lead, enlarged full threads schematically shown in a section (FIG. 11);

2) forming, when the lifting speed is equal to a product of the rotating speed and a thickness of a root portion of a thread tooth, enlarged shallow threads of transition type, schematically shown in a section (FIG. 12);

3) forming, when the lifting speed is equal to a product of the rotating speed and a thickness of an end portion of the thread tooth, enlarged shallow threads schematically shown in a section (FIG. 13);

4) forming, when the lifting speed is equal to a product of the rotating speed and a thickness of the rotating arm, an expanded cylindrical shape schematically shown in a section (FIG. 14).

Four nodal speeds are given in the above mentioned 1) to 4), and on this basis, in principle, through infinite change of the lifting speed v and the rotating speed n, countless transition shapes may be formed. The n types of compound extruded and expanded pile shapes of the present invention can be formed through free combinations of different pile body shapes.

Compared with the prior art, the pile-forming method for a compound extruded and expanded pile and the pile-forming equipment for a compound extruded and expanded pile in the present invention have the following advantages.

1. the pile-forming method for a compound extruded and expanded pile in the present invention has the unique technical feature of "a small bore during drilling and a large pile after lifting the drilling member", and solves the following defects and problems in the conventional technologies:

(1) Phenomenon of disordered threads wherein since threads of the compound extruded and expanded pile are generated during the process of lifting the drill stem, even if the phenomenon of disordered threads is produced by the drilling stem during the drilling process, the expansion bodies are expanded during the process of lifting the drill stem, then new expansion threads are formed from bottom to top, therefore no phenomenon of disordered threads will be generated.

(2) Phenomenon of insufficient torque and large energy consumption wherein in the conventional technologies, after the pile diameter is increased, the required torque of the drill stem is also correspondingly increased, therefore the mechanical costs are high, and the energy consumption is large, while the large energy consumption mainly occurs in the process of down drilling of the drill stem. For construction of piles with the same pile diameter, in the construction method of a compound extruded and expanded pile, since the outer diameter of the drill stem is smaller than the designed pile diameter during drilling, it is only needed to extrude and expand the formed bore to form a pile during lifting, therefore the torque required is small, and the energy consumption is low.

2. For the pile-forming equipment for a compound extruded and expanded pile in the present invention, the force bearing is reasonable, and the resistance torque is large. All of the extruding and expanding methods mentioned in Background Art of the present invention are operated under the most adverse operating conditions, wherein external resistance is loaded onto the extruding and expanding devices in a form of bending moment, thus requirements to the material strength is extremely high. However, in the present invention, the external resistance is loaded onto the extruding and expanding equipment in a form of axial force, so that the extruding and expanding equipment is under the most favorable force bearing condition. Moreover, the extruding and expanding manner in the present invention is mechanical rather than the oil pressure form, and the extruding to form a bore, the lifting for extrusion and expansion, and the forming a pile are completed in one step, so that the construction is quite simple and quick.

3. The pile-forming equipment for a compound extruded and expanded pile in the present invention has the special advantage of continuous extrusion and expansion, to overcome the defects that the three-fork extruded and expanded pile and the branch pile cannot be continuously extruded or expanded. Even in construction of the enlarged head, its extruding and expanding efficiency is also far greater than the extruding and expanding devices of the three-fork extruded and expanded pile and the branch pile and so on. Moreover, the pre-formation of a bore is not needed, avoiding numerous unfavorable influences caused by the pre-formation of a bore, for example, slurry, bore collapse, loose soil at the pile end and other defects. Therefore, the pile-forming equipment for a compound extruded and expanded pile in the present invention has prominent substantive features and notable technical progresses.

4. The pile-forming equipment for a compound extruded and expanded pile in the present invention realizes a specific construction method by using the specific function of the compound extrusion and expansion drilling tool and the match between power and speed achieved by its automatic control system, adjusts the drilling speed and the lifting speed, and can form various types of compound extruded and expanded piles. This pile-forming equipment for a compound extruded and expanded pile can be suited to local conditions, avoiding defects of the conventional technology, such as, it has only one pile type and the application range is restricted.

5. The control system of the pile-forming equipment for a compound extruded and expanded pile in the present invention employs precise synchronization of pressurization and lifting power, and can realize free enlargement and retraction of the expansion body, ensuring the bore formation and the pile formation of the straight-stem segment and threaded segment of different pile types.

6. In the pile-forming method for a compound extruded and expanded pile in the present invention, during the process of the compound extrusion and expansion drilling tool which extrudes and expands the bore more than three times for forming the bore and the pile, when the compound extrusion and expansion drilling tool drills down, lifts and expands the bore, the soil in the original pile bore is extruded and expanded into the side wall of the pile bore, such that the soil around the pile and the soil at the pile end are compacted more effectively than the existing non-displacement pile and the displacement pile. Moreover, the pile is expanded outwardly according to the design requirements, to form one or more enlarged heads, so that the frictional force of the soil at the pile side and the bearing force of the soil at the pile end are significantly increased.

7. With the pile-forming method for a compound extruded and expanded pile in the present invention, during the process of drilling and lifting for extrusion and expansion, the soil is reasonably compacted according to the sensitivity of the soil, therefore it can avoid during the pile-forming process the displacement to the inside of the bore and the strength attenuation, which are resulted from stress release of the soil around the pile, that is in turn caused by collapse of pile bore, slurry adhesion to the wall, sediment on the pile bottom, and soil being removed from the pile bore, appearing in the forming method of a non-displacement pile. Under the condition of the same soil layer, the same pile diameter, and the same pile length, compared with the branch pile and the three-fork extruded and expanded pile in form of soil removal, the compound extruded and expanded pile formed through the pile-forming method for a compound extruded and expanded pile in the present invention has prominent advantages, such as higher bearing capacity, less settlement amount, better quality, lower costs, less energy consumption, higher efficiency, and better environmental protection. Therefore, the pile-forming method for a compound extruded and expanded pile in the present invention has prominent substantive features and notable technical progresses.

8. With use of the pile-forming method for a compound extruded and expanded pile and the pile-forming equipment for a compound extruded and expanded pile thereof in the present invention, the construction speed is quicker, and in addition, the pile-forming method for a compound extruded and expanded pile and the pile-forming equipment for a compound extruded and expanded pile thereof in the present invention have a high pile-forming quality, and can operate under various complex geological conditions.

Figure 1:
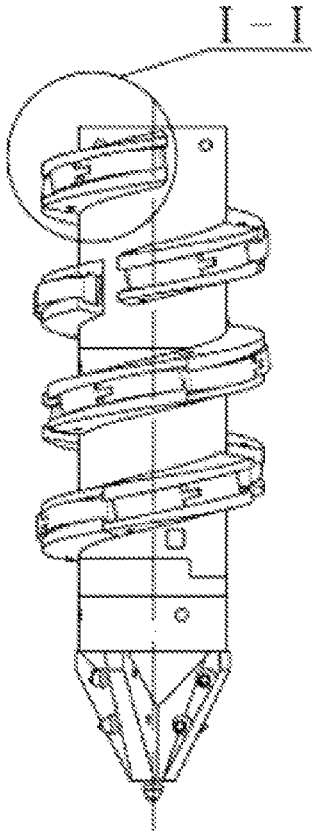
FIG. 1 is a structural schematic diagram of a compound extrusion and expansion drilling tool in the present invention when it is not enlarged.
Figure 2:
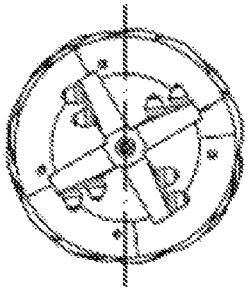
FIG. 2 is a top view of a compound extrusion and expansion drilling tool in the present invention when it is not enlarged.
Figure 3:
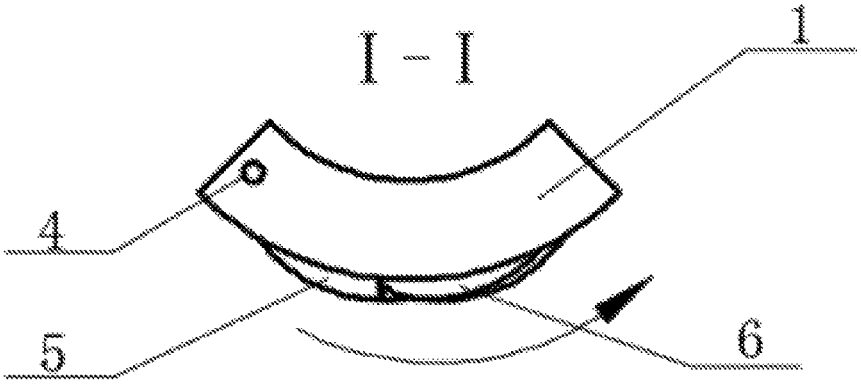
FIG. 3 is a partially enlarged view of the portion I-I in FIG. 1.
Figure 4:
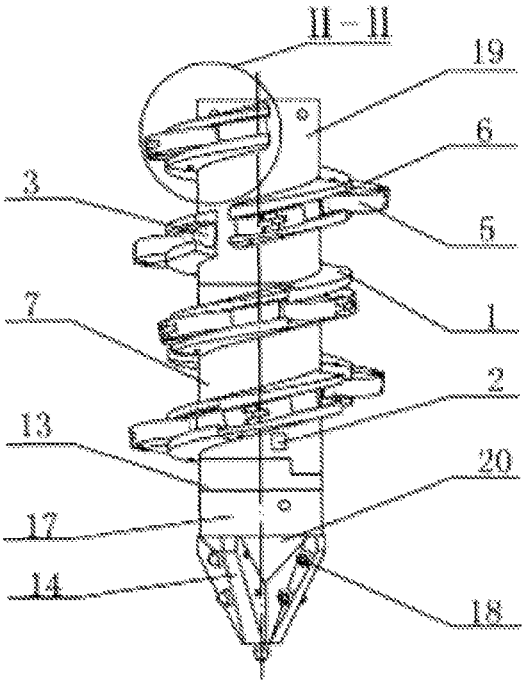
FIG. 4 is a structural schematic diagram of the compound extrusion and expansion drilling tool in the present invention when it is enlarged.
Figure 5:
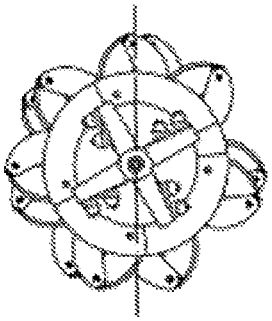
FIG. 5 is a top view of the compound extrusion and expansion drilling tool in the present invention when it is enlarged.
Figure 6:
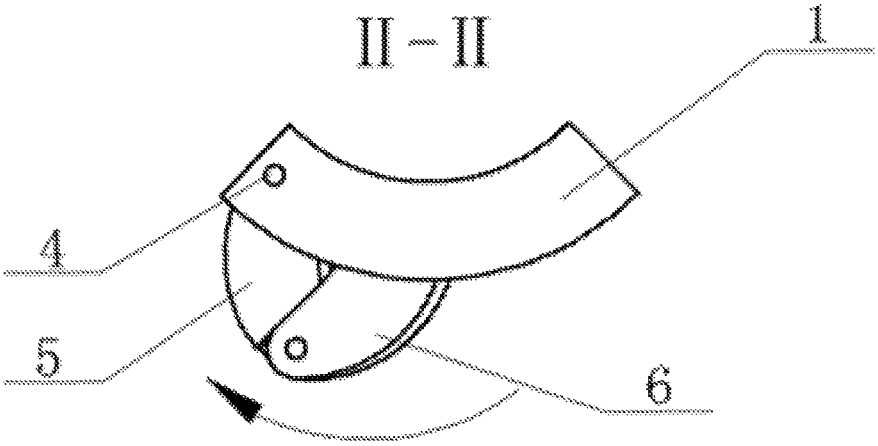
FIG. 6 is a partially enlarged view of the portion II-II in FIG. 4.
Figure 7:
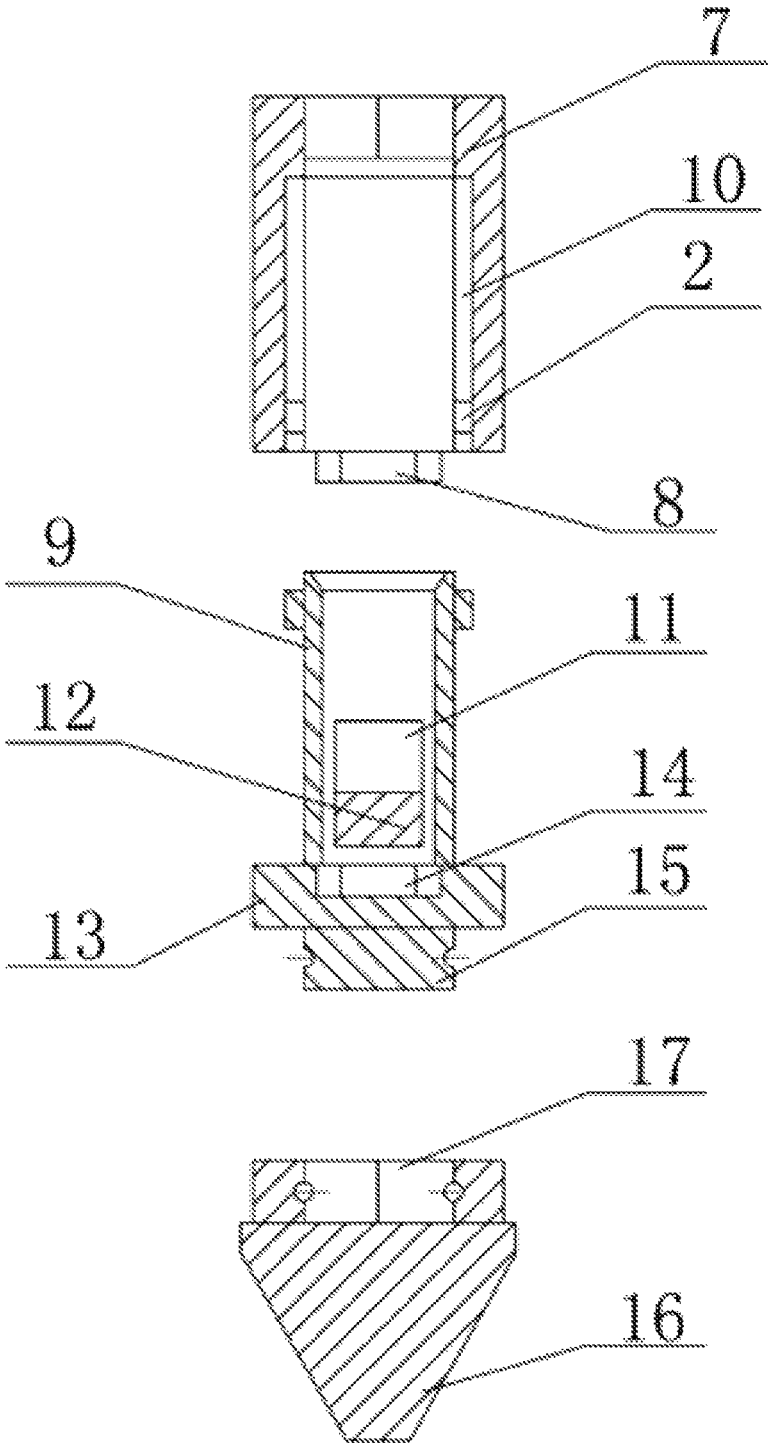
FIG. 7 is an assembly view of the compound extrusion and expansion drilling tool in the present invention.
Figure 8:
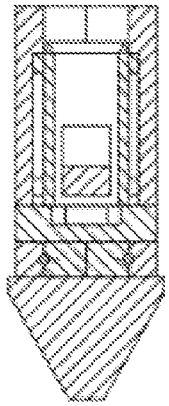
FIG. 8 is a sectional view of the compound extrusion and expansion drilling tool in the present invention before a sleeve is separated from a drill tip.
Figure 9:
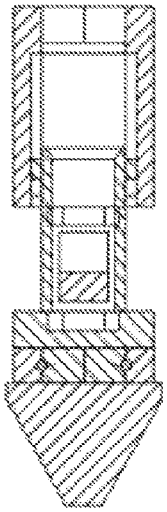
FIG. 9 is a sectional view of the compound extrusion and expansion drilling tool in the present invention after the sleeve is separated from the drill tip.
Figure 10:
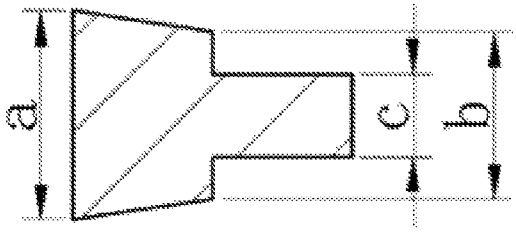
FIG. 10 is a cross-section view of an expansion body in the present invention.

In the figures: 1 indicates an expansion female tooth; 2 indicates a pin hole; 3 indicates an expansion sliding groove; 4 indicates a hinge point; 5 indicates a rotating arm; 6 indicates a sliding arm; 7 indicates an outer sleeve; 8 indicates an outer sleeve boss; 9 indicates an inner sleeve; 10 indicates a sliding groove; 11 indicates a valve; 12 indicates a transition panel; 13 indicates a connector; 14 indicates a recess; 15 indicates hexagonal-prism boss; 16 indicates a rectangular-pyramid drill tip; 17 indicates a hexagonal-prism recess; 18 indicates an alloy drill tooth; 19 indicates a conventional drill stem; 20 indicates a conical transition panel.

DETAILED DESCRIPTION OF EMBODIMENTS

Below, the present invention is further described in conjunction with figures.

In structures as shown in FIG. 1 to FIG. 15, the pile-forming equipment for a compound extruded and expanded pile designed in the present invention comprises a compound extrusion and expansion drilling tool and a control system thereof. The compound extrusion and expansion drilling tool comprises a drill stem. A plurality of expansion bodies are provided on a threaded section of a drill bit of the drill stem.

The drill stem comprises a hollow outer sleeve 7 and an inner sleeve 9 provided inside the outer sleeve. An upper portion of the outer sleeve is connected with a conventional drill stem 19. A bottom portion of the outer sleeve is provided with more than one outer sleeve boss 8 circumferentially distributed. A sliding groove 10, in which the inner sleeve can slide linearly, is provided at an inner side of the outer sleeve. A lower portion of the inner sleeve is provided with more than one valve 11 used for pouring a pile material under pressure. A transition panel 12 is provided on the inner sleeve at a position below the valves 11. A lower surface of the inner sleeve is connected with a connector 13, wherein an upper surface of the connector has a recess 14 matching bottom portions of the bosses of the outer sleeve, a lower surface of the connector is a hexagonal-prism boss 15, the connector is connected with a rectangular-pyramid drill tip 16 through the hexagonal-prism boss. According to the design of the present invention, the drill tip also can be directly designed in such a way that a bottom portion of the drill tip is provided with more than one unidirectional valve, and a concrete directly flows out from the unidirectional valves. In construction, the concrete, pumped by a pumper, enters into the drill stem through a concrete pipe, and passes through a hollow concrete tube to arrive to the drill tip 16 for forming a pile by pouring. Here, the rectangular-pyramid drill tip 16 also can be an isosceles triangular pyramid, a triangular pyramid, a pentagonal pyramid, and the like. An upper portion of a rectangular-pyramid drill tip is a hexagonal-prism recess 17 which is connected with the connector 13. Edges and a tip portion of the drill tip are provided with a plurality of alloy drill teeth 18 respectively. The tip portion of the pyramid can have an increasing cross section so as to be adapted to construction on relatively harder soil. The conical transition panel 20 is distributed between two edges of the drill tip, and the conical transition panel 20 facilitates the drill tip easily drilling in, to extrude the soil to the soil body at both sides. When an improved design is used, the conical transition panel can be used as a unidirectional gate for controlling flow-out of the concrete.

The expansion body, provided on the threads along an Archimedean spiral line, comprises expansion female teeth 1, rotating arms 5, and sliding arms 6. The expansion female tooth 1, forming one section of the intact threads, has stop means at its both ends. The expansion female tooth is provided with an expansion sliding groove 3. One end of the sliding groove has one hinge point 4. The rotating arm 5 has one end connected to the expansion sliding groove 3 and one end hinged with the sliding arm 6. The sliding arm has one end hinged with the rotating arm and one end assembled into the expansion sliding groove 3 to slide therein. When the drill stem is rotated clockwise, the expansion body initially is in a retraction state; when the drill stem is rotated anticlockwise, under combined effect of a torque of the pile machine, the frictional force of the soil, the pressure and so on, the rotating arm 5 in the expansion female tooth 1 is allowed to slide towards the hinge point 4 and to be rotated clockwise along with the rotating arm 5 until it arrives at an extreme position, entering an enlarged state. The expansion body in the enlarged state recovers the retraction state very easily under an acting force in the anticlockwise direction.

As further improvement on the technical solution of the present invention, the expansion female teeth 1 of the expansion body and thread teeth of thread of a drill bit are arranged at equal thread pitches, the cross-section of the expansion female tooth is a variable cross-section polygon, with a thickness of a tooth root thereof being greater than a thickness of a tooth crest, wherein one end of the sliding arm 6 of the expansion body, in a cylindrical shape, slides in the expansion sliding groove 3, the semi-lunar portions of the rotating arm and the sliding arm have a thickness smaller than the thickness of the tooth crest of the expansion female tooth, and smaller than a thickness of a cylinder at its end.

A mathematical expression of an outreach L of the expansion body in the above mentioned compound extrusion and expansion drilling tool is as follows:

$$L = l_1 + \frac{d_3}{2} - \frac{d_2}{2} - L_0 \tag{1}$$

$$\text{Note } \gamma = \frac{\theta_0 - 2\theta_1}{4} \tag{2}$$

$$l_0 = \frac{d_1 + d_3}{2}\tan\frac{\theta_0 - 2\theta_1}{2} = \frac{d_1 + d_3}{2}\tan 2\gamma \tag{3}$$

$$L_0 = \frac{d_1 + d_3}{2} \cdot \frac{1}{\cos\frac{\theta_0 - 2\theta_1}{2}} + \frac{d_3}{2} - \frac{d_2}{2} = \frac{d_1 + d_3}{2\cos 2\gamma} + \frac{d_3}{2} - \frac{d_2}{2} \tag{4}$$

$$\sin\theta_1 = \frac{d_3}{d_1 + d_3} \tag{5}$$

When two arms are in an enlarged state, according to the sine rule, $$\frac{l_0}{\sin\left(\frac{(\theta_0 - 2\theta_1)/2}{2}\right)} = \frac{\frac{d_1 + d_3}{2}}{\sin\alpha} = \frac{l_1}{\sin\left(\pi - \alpha - \frac{(\theta_0 - 2\theta_1)/2}{2}\right)} \tag{6}$$

$$\text{obtaining } l_1 = \frac{d_1 + d_3}{2}\cos\gamma + \frac{\sqrt{4l_0^2 - (d_1 + d_3)^2 \cdot \sin^2\gamma}}{2} \tag{7}$$

therefore, $$L = l_1 + \frac{d_3}{2} - \frac{d_2}{2} - L_0 = l_1 + \frac{d_3}{2} - \frac{d_2}{2} - \left(\frac{d_1 + d_3}{2\cos 2\gamma} + \frac{d_3}{2} - \frac{d_2}{2}\right) = \frac{d_1 + d_3}{2}\cos\gamma + \frac{\sqrt{4l_0^2 - (d_1 + d_3)^2 \cdot \sin^2\gamma}}{2} - \frac{d_1 + d_3}{2\cos 2\gamma} = \frac{d_1 + d_3}{2}\left(\cos\gamma + \sqrt{\tan^2 2\gamma - \sin^2\gamma} - \frac{1}{\cos 2\gamma}\right) \tag{8}$$

Since an initial angle between two arms cannot be greater than 180°, otherwise the retraction cannot be performed, i.e. $\theta_0 < 180°$, according to (1), obtaining:

$$0 < \gamma < 45° - \frac{1}{2}\theta_1 \tag{9}$$

In these expressions, $d_1$ represents a diameter of a core tube;

$d_2$ represents the maximum outer diameter of an original thread;

$d_3$ represents a diameter of a cylindrical sliding block;

$L_0$ represents an extension length of two initial arms when enlarging;

$l_0$ represents a length of a sliding block, a bore-to-bore distance;

$\theta_0$ represents a central angle of an expansion body;

$\theta_1$ represents an angle between a boundary of an expansion body and the sliding block;

$l_1$ represents a bore-to-bore distance when two arms are in an enlarged state;

$\alpha$ represents an angle between two sliding blocks when two arms are in an enlarged state.

When $d_1$=400 mm and $d_3$=60 mm, according to (5), L=88.17 is obtained, by putting $d_1$=400 mm and $\gamma$=18.76° into (8).

According to (9), the maximum outreach L=151.27 is obtained.

Besides, the outreach L can be changed depending on changes of the above mentioned relevant parameters, and according to this principle, designs of other outreaches obtained by changing the above mentioned parameters fall within the scope of the claims of the present patent.

In the present invention, an angle between the expansion bodies should ensure a disassembly space for the rotating arm 5 and the sliding arm 6. The number of circles formed by the expansion bodies should be more than one. Two expansion bodies are designed to be connected to form an expansion body pair, and each two pairs of expansion body are arranged with an angle of 30° therebetween. The total number of circles is more than one. Six expansion body pairs are designed to be used, forming three and a half circles. Other numbers and manners of the expansion bodies arranged along the spiral line fall within the scope of the claims of the present patent.

The control system used in the present invention is an advanced automatic control system, completing the match and control of double motors (the power of lifting the drill stem under pressure and the power of rotating the drill stem) of the pile machine. Here, the power of lifting under pressure controls a speed of drilling (or lifting) of the drill stem, and the rotating power controls the rotating speed of the drill stem. When the drill stem is lifted by one lead S and the drilling tool rotates for one turn, a pile body formed by pouring the pile material is in a threaded shape; when the drill stem is lifted or lowered by one lead S and the drilling tool rotates for several turns, a pile body formed by pouring the pile material is substantially in a cylindrical shape. A thread pitch of the threads is P, the number of the threads is $\lambda$, and the lead is S, therefore $S=\lambda \cdot P$, the speed of drilling (or lifting) of the drill stem is $v$, and the rotating speed of the drill stem is n. The different numbers of the threads all fall within the scope of the claims of the present patent.

Figure 11:
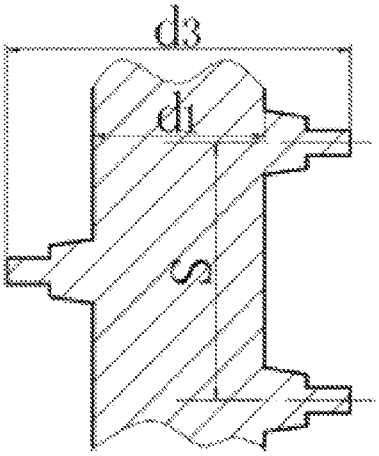
FIG. 11 is a sectional schematic diagram of enlarged full threads formed in the present invention.
Figure 12:
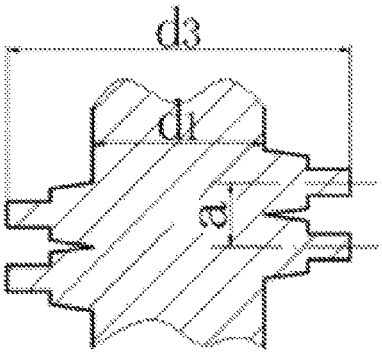
FIG. 12 is a sectional schematic diagram of enlarged shallow threads of transition type in the present invention.
Figure 13:
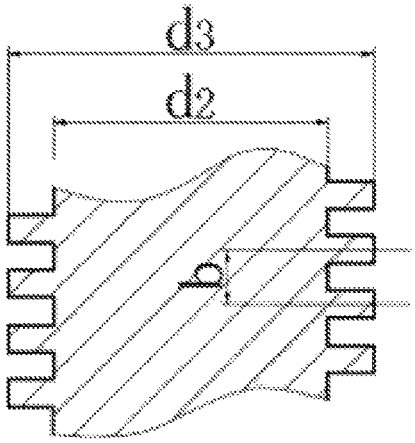
FIG. 13 is a sectional schematic diagram of enlarged shallow threads in the present invention.
Figure 14:
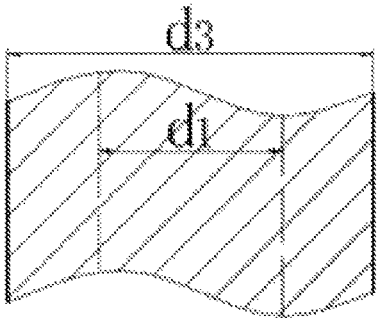
FIG. 14 is a sectional schematic diagram of cylindrical shape formed in the present invention.
Figure 15:
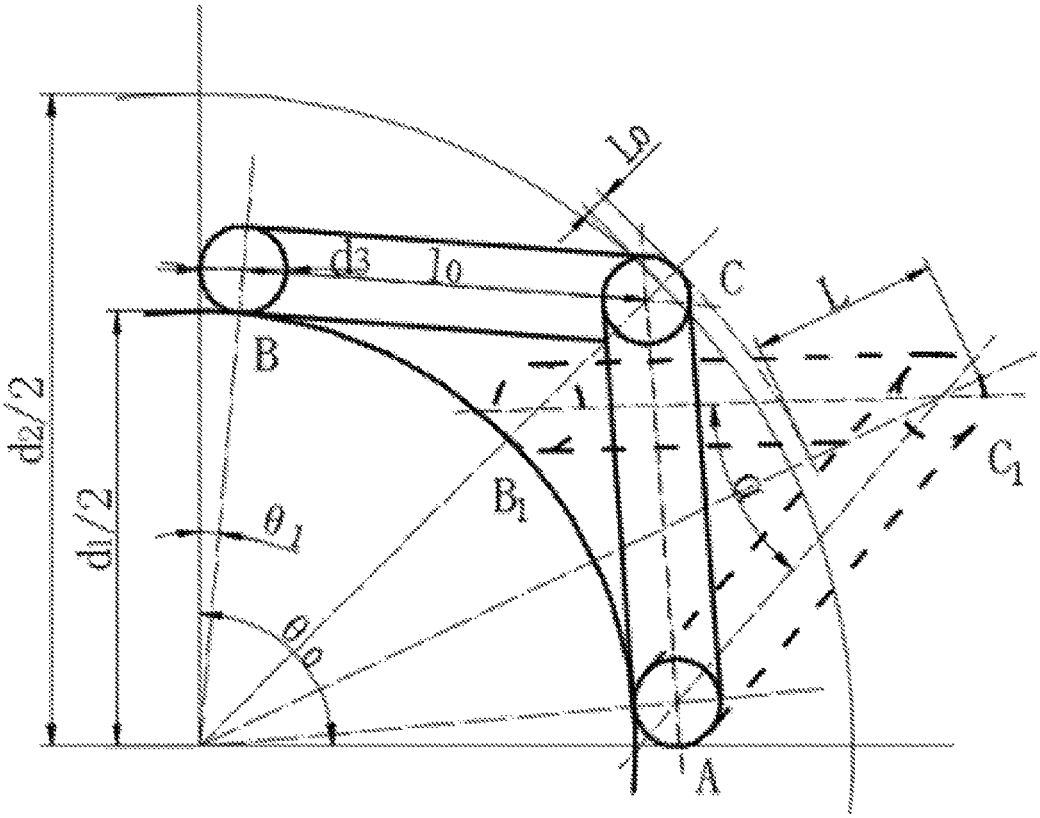
FIG. 15 is a diagram of calculating an outreach.

The drill stem can be controlled to rotate positively or reversely through an automatic control system according to requirements, which can realize: 1) positive and reverse rotation of the drill stem, 2) the expansion body being passively retracted and enlarged, 3) keeping different mathematical relationships between the lifting speed $v$ of the drill stem and the rotating speed n of the drill stem, to realize the following four basic types of the shape of the pile body:

1) forming, when $$v \cdot \frac{1}{n} = S,$$

i.e., v=nS, enlarged full threads schematically shown in a section (FIG. 11);

2) forming, when $$v \cdot \frac{1}{n} = a,$$

i.e. v=nα, enlarged shallow threads of transition type schematically shown in a section (FIG. 12);

3) forming, when $$v \cdot \frac{1}{n} = b,$$

i.e. v=nb, enlarged shallow threads schematically shown in a section (FIG. 13);

4) forming, when $$v \cdot \frac{1}{n} \leq c,$$

i.e. v≤nc, an expanded cylindrical shape schematically shown in a section (FIG. 14).

Four nodal speeds are given in the above mentioned 1) to 4). On this basis, through infinite change of the lifting speed v and the rotating speed n, numerous types of transition shapes can be formed theoretically. The n types of compound extruded and expanded pile shapes in the present invention can be formed through free combinations of different pile body shapes.

Figure 16:
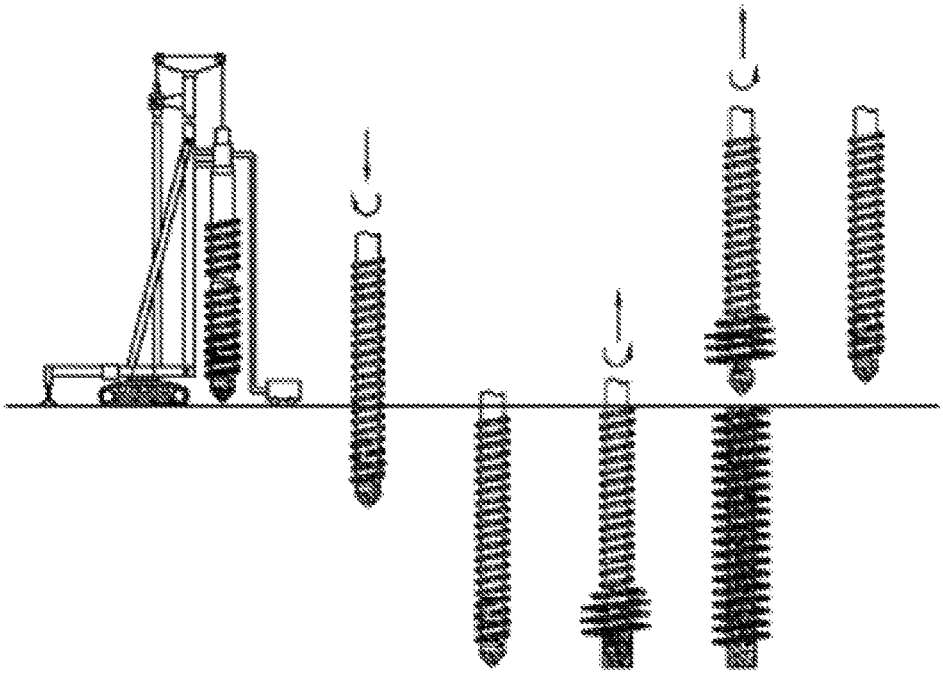
FIG. 16, FIG. 17, FIG. 18, FIG. 19, FIG. 20, FIG. 21, FIG. 22, and FIG. 23 are construction flow charts of the pile-forming method for a compound extruded and expanded pile in the present invention.

The pile-forming method of the pile-forming equipment for a compound extruded and expanded pile provided in the present invention comprises the following steps:

1. after a drilling machine for piling work installed with the pile-forming equipment for a compound extruded and expanded pile is located in place, the drilling machine for piling work is started up to apply a torque in a clockwise direction and a downward axial pressure, and a drilling tool of the pile-forming equipment for a compound extruded and expanded pile is used to drill, extrude, and expand to form a bore, wherein after the extrusion and expansion, the diameter of the bore for a pile is the outer diameter of the drill stem, the drilling tool of the pile-forming equipment for a compound extruded and expanded pile is rotated downwardly to mechanically extrude and expand to form the bore until a designed depth is reached;

2. after mechanical extrusion and expansion of the bore for the pile is completed in the first step, the drilling machine for piling work is started up to rotate anticlockwise and lift the drilling tool, the expansion bodies of the pile-forming equipment for a compound extruded and expanded pile are enlarged, wherein the expansion bodies are always in the enlarged state during the process of lifting the drilling tool of the pile-forming equipment for a compound extruded and expanded pile; a concrete pump is started up while the drilling tool of the pile-forming equipment for a compound extruded and expanded pile starts to be upwardly rotated and lifted, and under the effect of pressure of the concrete pump, the inner sleeve 9 is separated from the outer sleeve 7, and the inner sleeve 9 slides in the sliding groove 10 until it arrives at a stop pin hole 2, and at this time, it is in a separate state; the concrete passes through a hollow concrete conveying pipe, rushes out from a valve 11 of the inner sleeve, and quickly fills up the drill tip and piles up above a prescribed height; during the process of lifting the drilling tool of the pile-forming equipment for a compound extruded and expanded pile, the concrete is pumped continuously, and is always above the prescribed valve height;

3. the lifting speed is kept equal to a product of the rotating speed and the thread lead, until the pile material is poured under pressure to reach a pile top mark height, obtaining a compound extruded and expanded fully-threaded pile (as in FIG. 16). When the drilling machine for piling work forms the bore, the threads of the drill stem have an inner diameter $d_1$, an outer diameter $d_2$, and a thread pitch S; when forming the pile, the enlarged threaded portion has an inner diameter $d_1$, an outer diameter $d_2$+L, and a thread pitch S;

4. after the drilling tool of the pile-forming equipment for a compound extruded and expanded pile is lifted to the ground, the enlarged portion of the drill stem is manually reset to the initial state, completing the pile construction.

Figure 17:
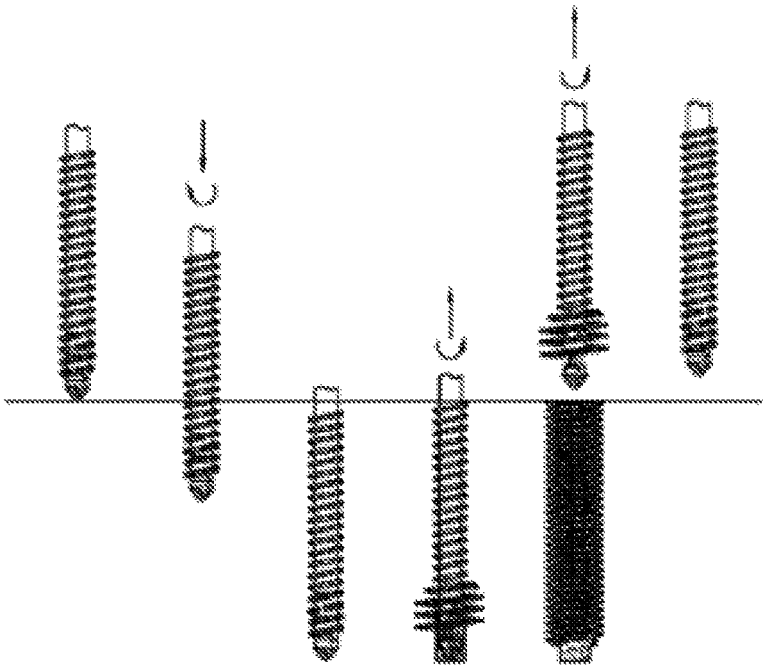

Further, in a first improved technical solution of the present invention, the lifting speed is equal to a product of the rotating speed and a thickness of an end portion of the thread tooth, to obtain a compound extruded and expanded shallow-threaded pile (as in FIG. 17). When the drilling machine for piling work forms the bore, the threads of the drill stem have an inner diameter $d_1$, an outer diameter $d_2$, and a thread pitch S; when forming the pile, the expanded shallow-threaded pile has an inner diameter $d_2$, an outer diameter $d_2$+L, and a thread pitch of c.

Figure 18:
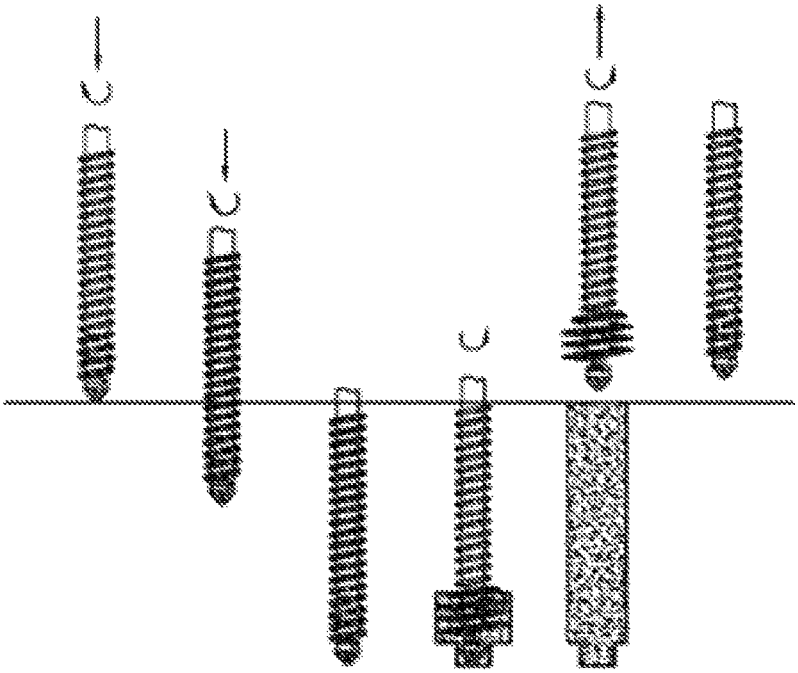

Further, in a second improved technical solution of the present invention, after formation of the bore for the pile is completed through mechanical extrusion and expansion, the drilling machine for piling work is started up to rotate anticlockwise in situ, so that the formed bore is further expanded and extruded by the expansion bodies of the equipment, forming a cylinder shape having the diameter equal to that of the enlarged portion of the equipment, and then the drilling tool is lifted, and at the same time, the concrete is pumped, keeping the lifting speed not greater than the product of the rotating speed and the thickness of the rotating arm until the pile material is poured under pressure to reach a pile top mark height, forming a compound extruded and expanded non-threaded pile (as in FIG. 18). When the drilling machine for piling work forms the bore, the threads of the drill stem have an inner diameter $d_1$, an outer diameter $d_2$, and a thread pitch S; when forming the pile, the enlarged cylinder has an outer diameter $d_2$+L, without threads.

Figure 19:
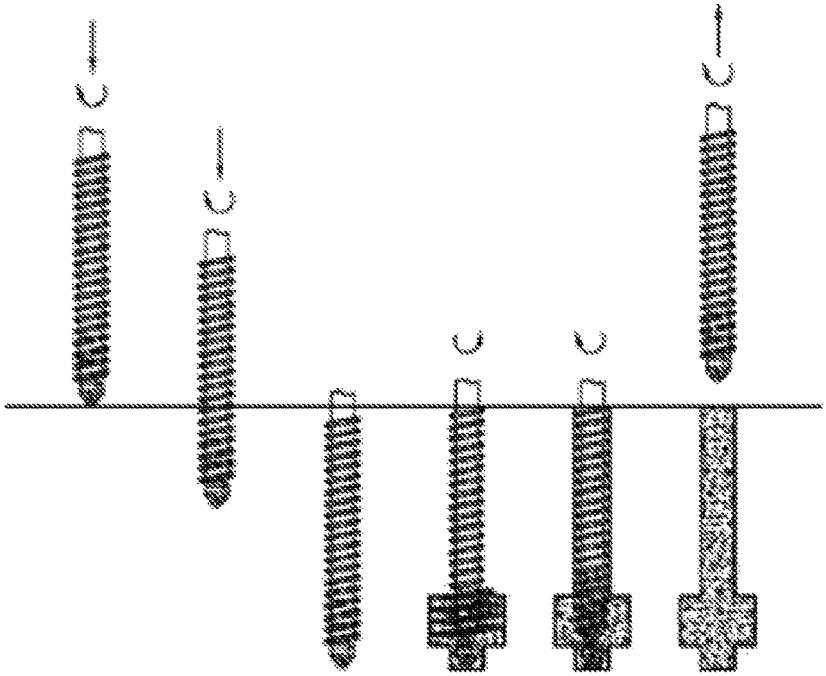
Figure 20:
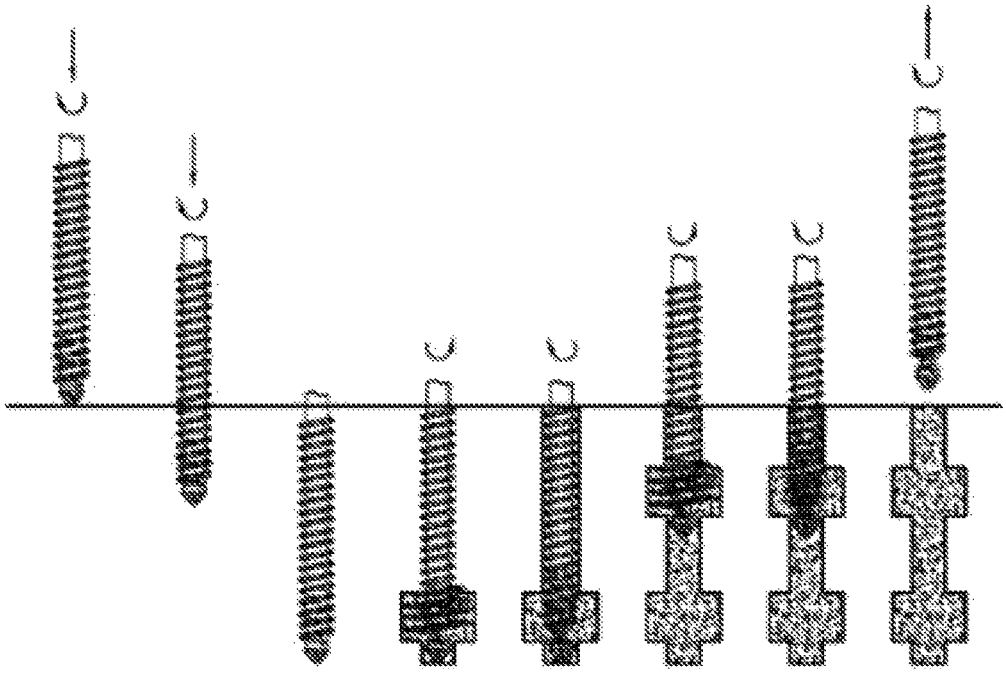

Further, in a third improved technical solution of the present invention, after formation of the bore for the pile is completed through mechanical extrusion and expansion, the drilling machine for piling work is started up to rotate anticlockwise in situ, so that the formed bore is further expanded and extruded by the expansion bodies of the equipment, forming a cylinder shape having a diameter equal to that of the enlarged portion of the equipment, and then the drilling tool is rotated and lifted, and a concrete is pumped continuously, wherein when the cylinder formed through extrusion is filled up with the concrete, the drilling machine for piling work rotates clockwise in situ, so that the expansion bodies are converted into a retraction state, keeping the rotating speed and the lifting speed until the pile material is poured under pressure to reach a pile top mark height, forming a compound extruded and expanded pile with an enlarged head (as in FIG. 19). When the drilling machine for piling work forms the bore, the threads of the drill stem have an inner diameter $d_1$, an outer diameter $d_2$, and a thread pitch S; when forming the pile, the pile has an outer diameter d1, and the enlarged head has an outer diameter $d_2$+L, without threads. According to the design of the pile-forming solution, by repeating the above mentioned steps of forming the enlarged head at any positions of the bore for the pile, a compound extruded and expanded pile having a plurality of enlarged heads on the pile body can be formed (as in FIG. 20). The pile body has n (n≥1) enlarged heads, and the summation of heights of the enlarged heads is less than the pile length.

Figure 21:
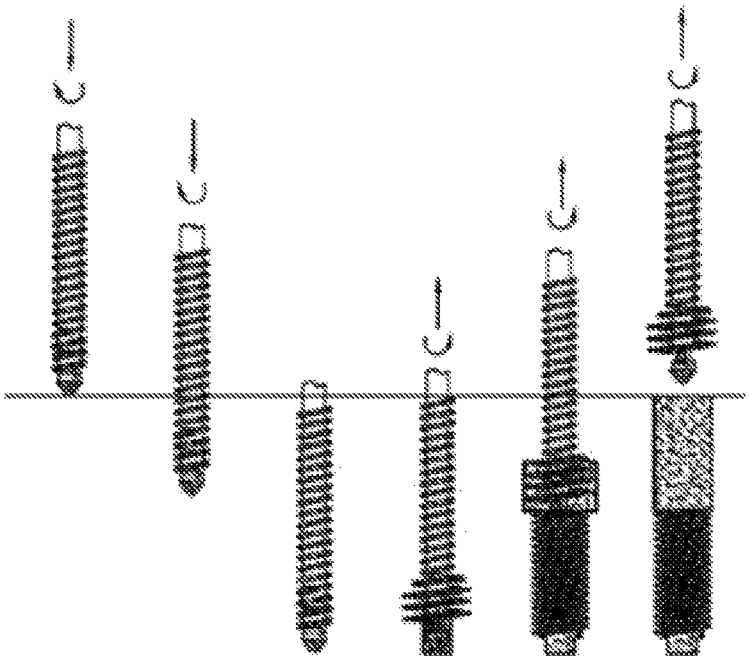

Further, in a fourth improved technical solution of the present invention, after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thread lead, and a concrete is pumped continuously while the drilling tool of the pile-forming equipment for a compound extruded and expanded pile starts to be upwardly rotated and lifted; when the drilling tool rises to a straight-rod section, a torque in an anticlockwise direction is applied, and the expansion bodies are converted into an enlarged state; after a space where the expansion bodies are located is extruded into a cylinder shape and the concrete has been filled in, a torque in a clockwise direction is applied; the speed of lifting the drilling tool is kept not greater than a product of the rotating speed and a thickness of the rotating arm until the pile material is poured under pressure to reach a pile top mark height, forming a compound extruded and expanded fully-threaded pile (as in FIG. 21). The pile is in the form where an upper portion is a straight rod and a lower portion is threads, or an upper portion is threads and a lower portion is a straight rod, wherein the lengths of the two are adjustable. When the drilling machine for piling work forms the bore, the threads of the drill stem have an inner diameter $d_1$, an outer diameter $d_2$, and a thread pitch S; when forming the pile, the straight rod section has an outer diameter $d_2$+L, and the threaded section has an inner diameter $d_1$, an outer diameter $d_2$+L, and a thread pitch S.

Figure 22:
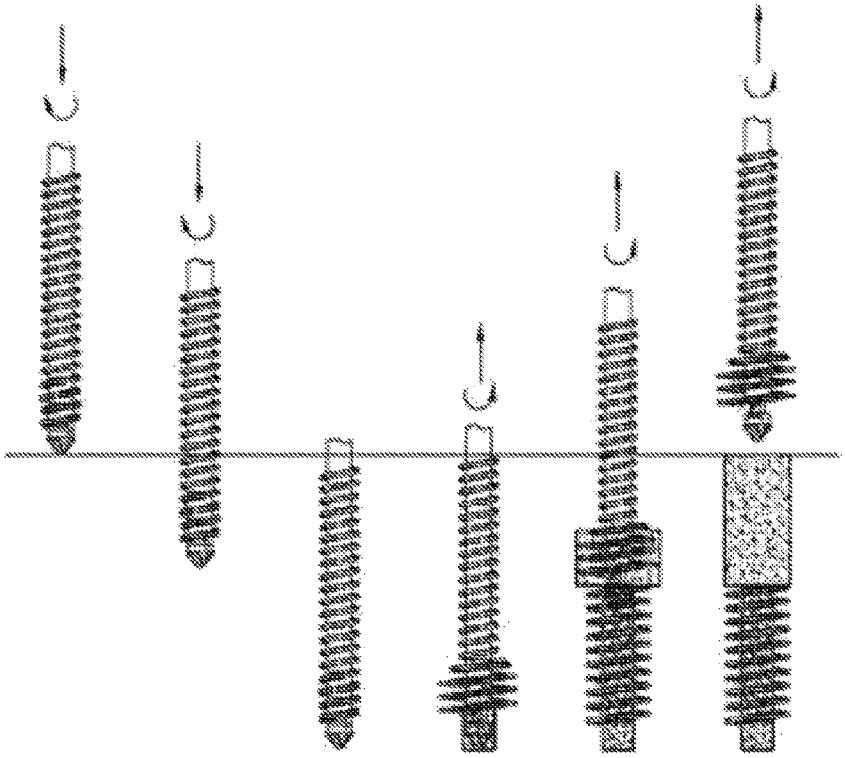

Further, in a fifth improved technical solution of the present invention, after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thickness of an end portion of a thread tooth, and a concrete is pumped continuously while the drilling tool of the pile-forming equipment for a compound extruded and expanded pile starts to be rotated upwardly and lifted; when the drilling tool rises to a straight-rod section, a torque in an anticlockwise direction is applied, and the expansion bodies are converted into an enlarged state; after the space where the expansion bodies are located is extruded into a cylinder shape and the concrete has been filled in, a torque in a clockwise direction is applied; the speed of lifting the drilling tool is kept not greater than a product of the rotating speed and a thickness of the rotating arm until the pile material is poured under pressure to reach a pile top mark height, forming a compound extruded and expanded pile with a screw rod and shallow threads (as in FIG. 22). The pile is in such type that an upper portion is a straight rod and a lower portion is threads, or an upper portion is threads and a lower portion is a straight rod, wherein the lengths of the two are adjustable. When the drilling machine for piling work forms the bore, the threads of the drill stem have an inner diameter $d_1$, an outer diameter $d_2$, and a thread pitch S; when forming the pile, the straight rod section has an outer diameter $d_2$+L, and the threaded section has an inner diameter $d_2$, an outer diameter $d_2$+L, and a thread pitch c.

Figure 23:
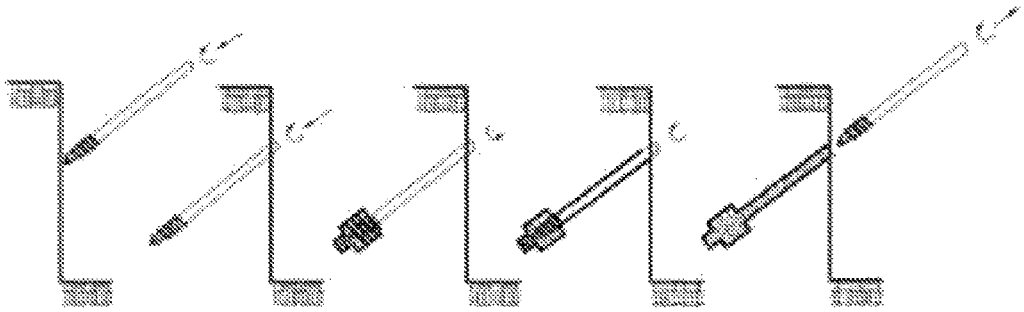

Further, in a sixth improved technical solution of the present invention, the drill stem perpendicular to the ground is changed to forming a certain angle with the ground, and the remaining of the pile-forming solution is similar to the above mentioned technical solutions and the improved technical solutions, especially when the third improved technical solution of the present invention is applied, the drill stem can be used as an anchoring rod (as in FIG. 23).

According to the design requirements of piles, a reinforcement cage, a bundle of bars, or structural steel also can be inserted into the compound extruded and expanded pile according to the conventional methods.

The present invention is illustrated in conjunction with the above mentioned examples. However, within the scope of the present invention, various different construction methods also can be derived through some suitable modification to the details of the construction steps. All similar pile types designed with similar methods fall within the scope of the claims.

The invention claimed is:

1. A pile-forming method for a compound extruded and expanded pile, characterized by comprising steps as follows:

1) starting up, after a drilling machine for piling work installed with pile-forming equipment for a compound extruded and expanded pile is located in place, the drilling machine for piling work, to apply a torque in a clockwise direction and a downward axial pressure, wherein a drilling tool of the pile-forming equipment for a compound extruded and expanded pile is used to drill, extrude, and expand to form a bore; after extrusion and expansion, a diameter of the bore for a pile is an outer diameter of a drill stem, the drilling tool of the pile-forming equipment for a compound extruded and expanded pile is rotated downwardly to mechanically extrude and expand to form the bore, until a designed depth is reached;

2) starting up, after mechanical extrusion and expansion of the bore for the pile is completed in the first step, the drilling machine for piling work, to rotate anticlockwise and lift the drilling tool, wherein expansion bodies of the pile-forming equipment for a compound extruded and expanded pile are enlarged, wherein the expansion bodies are always in an enlarged state during a process of lifting the drilling tool of the pile-forming equipment for a compound extruded and expanded pile, wherein a concrete pump is started up while the drilling tool of the pile-forming equipment for a compound extruded and expanded pile starts to be upwardly rotated and lifted, and under effect of pressure of the concrete pump, an inner sleeve is separated from an outer sleeve, and the inner sleeve slides in a sliding groove until arriving at a stop pin hole, and at this time, the inner sleeve and the outer sleeve are in a separate state; concrete passes through a hollow concrete conveying pipe to rush out from a valve, and quickly fill up a drill tip and pile up above a prescribed height, wherein during a process of lifting the drilling tool of the pile-forming equipment for a compound extruded and expanded pile, the concrete is pumped continuously, and is always kept above a prescribed valve height, until being poured under pressure to reach a designed top mark height of the pile;

3) keeping a lifting speed equal to a product of a rotating speed and a thread lead, until pile material is poured under pressure to reach a pile top mark height, obtaining a compound extruded and expanded fully-threaded pile;

4) manually resetting, after the drilling tool of the pile-forming equipment for a compound extruded and expanded pile is lifted to the ground, an enlarged portion of the drill stem to an initial state, completing construction of the pile.

2. The pile-forming method for a compound extruded and expanded pile according to claim 1, characterized in that the lifting speed is equal to a product of the rotating speed and a thickness of a root portion of a thread tooth, forming a compound extruded and expanded shallow-threaded pile.

3. The pile-forming method for a compound extruded and expanded pile according to claim 1, characterized in that after formation of the bore for the pile is completed through mechanical extrusion and expansion, the drilling machine for piling work is started up to rotate anticlockwise in situ, so that the formed bore is further expanded and extruded by the expansion bodies of the equipment, forming a cylinder shape having a diameter equal to that of enlarged portion of the equipment, and then the drilling tool is lifted, and at the same time, the concrete is pumped, keeping the lifting speed not greater than a product of the rotating speed and a thickness of a rotating arm until the pile material is poured under pressure to reach a pile top mark height, forming a compound extruded and expanded non-threaded pile.

4. The pile-forming method for a compound extruded and expanded pile according to claim 1, characterized in that after formation of the bore for the pile is completed through mechanical extrusion and expansion, the drilling machine for piling work is started up to rotate anticlockwise in situ, so that the formed bore is further expanded and extruded by the expansion bodies of the equipment, forming a cylinder shape having a diameter equal to that of the enlarged portion of the equipment, and then the drilling tool is rotated and lifted, and a concrete is pumped continuously, wherein when the cylinder formed through extrusion is filled up with the concrete, the drilling machine for piling work rotates clockwise in situ, so that the expansion bodies are converted into a retraction state, keeping the rotating speed and the lifting speed until the pile material is poured under pressure to reach a pile top mark height, forming a compound extruded and expanded pile with an enlarged head.

5. The pile-forming method for a compound extruded and expanded pile according to claim 1, characterized in that after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thread lead, and a concrete is pumped continuously while the drilling tool of the pile-forming equipment for a compound extruded and expanded pile starts to be upwardly rotated and lifted, wherein when the drilling tool rises to a straight-rod section, a torque in an anticlockwise direction is applied, and the expansion bodies are converted into an enlarged state; the formed bore is made to be further expanded and extruded by the expansion bodies of the equipment, forming a cylinder shape having a diameter equal to that of the enlarged portion of the equipment, and after the concrete has been filled in, a torque in a clockwise direction is applied; the lifting speed of the drilling tool is kept not greater than a product of the rotating speed and a thickness of the rotating arm until pile material is poured under pressure to reach a pile top mark height, forming a compound extruded and expanded fully-threaded pile.

6. The pile-forming method for a compound extruded and expanded pile according to claim 1, characterized in that after formation of the bore for the pile is completed through mechanical extrusion and expansion, the drilling machine for piling work is started up to rotate anticlockwise, so that the expansion bodies of the pile-forming equipment for a compound extruded and expanded pile are enlarged, the drilling tool is lifted, and the lifting speed is kept equal to a product of the rotating speed and a thickness of an end portion of a thread tooth, and a concrete is pumped continuously while the drilling tool of the pile-forming equipment for a compound extruded and expanded pile starts to be rotated upwardly and lifted, wherein when the drilling tool rises to a straight-rod section, a torque in an anticlockwise direction is applied, and the expansion bodies are converted into an enlarged state; the formed bore is made to be further expanded and extruded by the expansion bodies of the equipment, forming a cylinder shape having a diameter equal to that of the enlarged portion of the equipment, and after the concrete has been filled in, a torque in a clockwise direction is applied; the lifting speed of the drilling tool is kept not greater than a product of the rotating speed and a thickness of the rotating arm until pile material is poured under pressure to reach a pile top mark height, forming a compound extruded and expanded pile with a screw rod and shallow threads.

7. The pile-forming method for a compound extruded and expanded pile according to claim 1, characterized in that through improvement on the equipment, a main stand or a drill stem form 0-90° with ground under an effect of winching or a hydraulic cylinder, completing construction of an anchoring rod is completed, wherein the drill stem can be used as an anchoring rod and formed through a method of forming an anchoring rod.

8. A pile-forming equipment for a compound extruded and expanded pile of the pile-forming method for a compound extruded and expanded pile according to claim 1, characterized by comprising a compound extrusion and expansion drilling tool and a control system thereof, wherein the compound extrusion and expansion drilling tool comprises a drill stem, and a plurality of expansion bodies are provided on a threaded section of a drill bit of the drill stem;

the drill stem comprises a hollow outer sleeve and an inner sleeve provided inside the outer sleeve, an upper portion of the outer sleeve is connected with a conventional drill stem, a bottom portion of the outer sleeve is provided with more than one boss circumferentially distributed, a sliding groove, in which the inner sleeve can linearly slide, is provided at an inner side of the outer sleeve, a lower portion of the inner sleeve is provided with more than one inner sleeve valve used for pouring a pile material under pressure, a transition panel is provided at a position below the valve of the inner sleeve, a lower surface of the inner sleeve is connected with a connector, wherein an upper surface of the connector has a recess matching bottom portions of the bosses of the outer sleeve, a lower surface of the connector is a hexagonal-prism boss, the connector is connected with a rectangular-pyramid drill tip through the hexagonal-prism boss, an upper portion of a rectangular-pyramid drill tip is a hexagonal-prism recess which is connected with the connector; edges and a tip portion of the drill tip are provided with a plurality of alloy drill teeth respectively; the conical transition panel 20 is distributed between two edges of the drill tip;

the expansion bodies are provided on the threads along an Archimedean spiral line, and comprise expansion female teeth, rotating arms, and sliding arms, the expansion female tooth forms one section of intact threads, and has stop means at both ends thereof, the expansion female tooth is provided with an expansion sliding groove, one end of the expansion sliding groove has one hinge point, the rotating arm has one end connected to the expansion sliding groove and one end hinged with the sliding arm, the sliding arm has one end hinged with the rotating arm and one end assembled into the sliding groove to slide therein.

9. The pile-forming equipment for a compound extruded and expanded pile according to claim 8, characterized in that the expansion female teeth of the expansion body and thread teeth of threads of the drill bit are arranged at equal thread pitches, a cross-section of the expansion female tooth is a variable cross-section polygon, with a thickness of a tooth root thereof being greater than a thickness of a tooth crest, one end of the sliding arm of the expansion body is in a cylindrical shape, the rotating arm and the sliding arm have semi-lunar portions with a thickness smaller than the thickness of the tooth crest of the expansion female tooth, and smaller than a thickness of a cylinder at an end thereof.

10. The pile-forming equipment for a compound extruded and expanded pile according to claim 8, characterized in that an automatic control system is capable of realizing match and control of double motors of the pile machine, i.e., a power of lifting the drill stem under pressure and a power of rotating the drill stem, to realize: 1) positive rotation and reverse rotation of the drill stem; 2) passive retraction and enlargement of the expansion body; 3) keeping different mathematical relationships between a lifting speed of the drill stem and a rotating speed of the drill stem to realize four basic types of the shape of the pile body as follows:

1) forming enlarged full threads when the lifting speed is equal to a product of the rotating speed and the thread lead;
2) forming enlarged shallow threads of transition type when the lifting speed is equal to a product of the rotating speed and a thickness of a root portion of a thread tooth;
3) forming enlarged shallow threads when the lifting speed is equal to a product of the rotating speed and a thickness of an end portion of the thread tooth;
4) forming an expanded cylindrical shape when the lifting speed is equal to a product of the rotating speed and a thickness of the rotating arm, schematically shown in a section, wherein four nodal speeds are given in the above 1) to 4), and on this basis, through infinite change of the lifting speed and the rotating speed, numerous types of transition shapes can be formed theoretically, meeting requirements to shapes of the pile for different soil layers.

* * * * *